US006971173B2

(12) United States Patent
Guimard

(10) Patent No.: US 6,971,173 B2
(45) Date of Patent: Dec. 6, 2005

(54) METHOD OF MAKING A RIM FOR A VEHICLE WHEEL

(75) Inventor: Bruno Guimard, Chamalieres (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 10/437,555

(22) Filed: May 13, 2003

(65) Prior Publication Data

US 2004/0016124 A1 Jan. 29, 2004

Related U.S. Application Data

(63) Continuation of application No. PCT/EP01/12601, filed on Oct. 31, 2001.

(30) Foreign Application Priority Data

Nov. 13, 2000 (FR) ..... 00 14675

(51) Int. Cl.[7] ..... B21K 1/38; B60B 21/00

(52) U.S. Cl. ..... 29/894.354; 29/894.35; 301/95.108

(58) Field of Search ..... 29/894.35–894.354, 29/894.324; 301/95.108; 72/338, 203

(56) References Cited

U.S. PATENT DOCUMENTS

| | | | | |
|---|---|---|---|---|
| 3,129,496 A * | 4/1964 | Cox | | 29/894.324 |
| 4,143,533 A * | 3/1979 | Bosch | | 72/68 |
| 4,185,370 A | 1/1980 | Evans | | |
| 4,554,810 A * | 11/1985 | Jurus | | 72/70 |
| 5,435,633 A * | 7/1995 | Jaskierny | | 301/63.105 |
| 5,579,578 A | 12/1996 | Ashley, Jr. | | |
| 5,664,329 A * | 9/1997 | Nickel | | 29/894.324 |
| 5,832,609 A * | 11/1998 | Jansen | | 29/894.351 |
| 5,845,400 A * | 12/1998 | Takamoku | | 29/894.354 |
| 6,189,357 B1 * | 2/2001 | Baumgarten et al. | | 72/70 |
| 6,244,668 B1 * | 6/2001 | Hale et al. | | 301/95.105 |
| 6,450,583 B2 * | 9/2002 | Hale et al. | | 301/63.101 |
| 6,536,111 B1 * | 3/2003 | Baumgarten et al. | | 29/894.324 |

FOREIGN PATENT DOCUMENTS

| | | |
|---|---|---|
| DE | 19924062 | 9/1999 |
| WO | 9625257 | 8/1996 |

* cited by examiner

*Primary Examiner*—Marc Jimenez
(74) *Attorney, Agent, or Firm*—Buchanan Ingersoll PC

(57) ABSTRACT

A method of making a rim of sheet metal for a vehicle wheel, in which:

a rectangular geometric shape is cut out of a blank of sheet metal;

the blank is bent to obtain a cylindrical hoop;

the two free edges of the hoop are welded together;

at least one cylindrical flow spinning operation is performed to obtain a profile of given thickness of the hoop, zones of constant thickness being adjacent to zones of variable thickness;

a cut is made perpendicular to the axis of the hoop out of at least one lateral edge of the hoop;

the hoop is profiled to obtain the rim; and the size of the said rim is set.

8 Claims, 6 Drawing Sheets

METHOD OF MAKING A RIM FOR A VEHICLE WHEEL

CROSS REFERENCE TO RELATED APPLICATIONS

This is a continuation of international application No. PCT/EP 01/12601, filed Oct. 31, 2001, published in French as international publication No. WO 02/38303 on May 16, 2002 and claiming priority to French application No. 00/14675 filed Nov. 13, 2000, the entire contents of each of which are incorporated by reference.

BACKGROUND OF THE INVENTION

1. Field of the Invention

The invention relates to vehicle wheels and in particular to an improved method of making a wheel rim.

2. The Related Art

U.S. Pat. No. 5,579,578 discloses a method of making a wheel rim for a vehicle, which has the following operations:

cutting a rectangular geometric shape out of a blank of sheet metal;

bending the blank to obtain a cylindrical hoop;

welding the two free edges of the hoop together;

setting the size of the hoop to a given diameter;

performing a cylindrical flow spinning operation on the hoop to obtain a profile of the hoop having two axial ends and a thinner intermediate zone;

profiling the hoop by a series of rolling operations to obtain the rim; and setting the size of the said rim.

This patent states that performing the flow spinning operations before the roll profiling provides for a wheel rim with good manufacturing tolerances.

However, the flow spinning operations on the hoop of a wheel rim are liable to result in hoops that have an axial width that varies over its circumference. Additionally, in some instances, perpendicularity faults are observed between the plane defined by the edge of the hoop and that defined by the axis of the hoop. These variations and faults may cause instability during the succeeding operations of rolling the hoop, and they may also make it more difficult to attach the balance weights for the wheels in places.

SUMMARY OF THE INVENTION

An object of the present invention is to provide a method of manufacturing a wheel rim that can avoid the aforementioned problems.

A further object of the invention is to provide an improved method of making a wheel rim which is capable of reducing, to a substantial extent, the manufacturing variations of the wheel rims.

Still, a further object is to provide a method of making a wheel rim which allows lighter-weight wheels to be obtained.

A method of making a rim of sheet metal for a vehicle wheel according to an embodiment of the invention comprises the following steps:

a rectangular geometric shape is cut out of a blank of sheet metal;

the blank is bent to obtain a cylindrical hoop;

the two free edges of the hoop are welded together;

at least one cylindrical flow spinning operation is performed to obtain a profile of given thickness of the hoop, zones of constant thickness being adjacent to zones of variable thickness;

a cut is made perpendicular to the axis of the hoop out of at least one lateral edge of the hoop;

the hoop is profiled to obtain the rim; and the size of the said rim is set.

The operation of cutting perpendicular to the axis of the hoop out of at least one lateral edge of the hoop after the cylindrical flow spinning operation has the advantage of eliminating entirely or partly the excess thickness of the two ends of the finished rim, which reduces the final weight of the rim. It should be noted that the reduction in thickness during a flow spinning operation cannot be applied to the two lateral edges of the hoop. This thickness is thus necessarily identical to the thickness of the metal starting blank. This operation also ensures that the edge of the hoop is properly planar and that this plane is at a right angle to the axis of this same hoop.

The cutting-out operation may be performed from the inner side of the rim, which is the side of the rim that is intended to face towards the inside of the vehicle. This has the advantage of reducing the thickness of the inside hook of the rim, this hook being less exposed to impact than the outside hook.

The cutting-out operation may also be applied to the two lateral edges of the hoop. The advantage is then to maximize the reduction in weight of the rim and to obtain excellent planarity of the lateral edges of the hoop and outstanding regularity in the axial width of the hoop.

It is possible to cut out at the edge of the hoop only a part of the zone not subject to flow spinning. In this case, all the advantages linked with the geometric quality of the hoop obtained are obtained, but the reduction in weight is limited.

It is also possible to cut out at the edge of the hoop at least a part of the zone subject to flow spinning. The final rim will then have a particularly substantial advantage as regards its weight.

In one embodiment of the invention, the plane of cutting out of an edge of the hoop is defined with reference to a characteristic point on the profile of the hoop after the flow spinning operation. This characteristic point may in particular be a point of transition between a zone of constant thickness and a zone of variable thickness.

It is thus possible to adjust the position of the transition zones between flow spun zones and the edge of the hoop. This improves the ability to observe tolerances of the dimensions of the final rim.

Additional objects and advantages of the invention will be set forth in part in the more detailed description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate various embodiments of the invention and, together with the description, serve to explain the principles of the invention.

DETAILED DESCRIPTION OF THE INVENTION

Reference will now be made in detail to the present invention.

Figure 1:
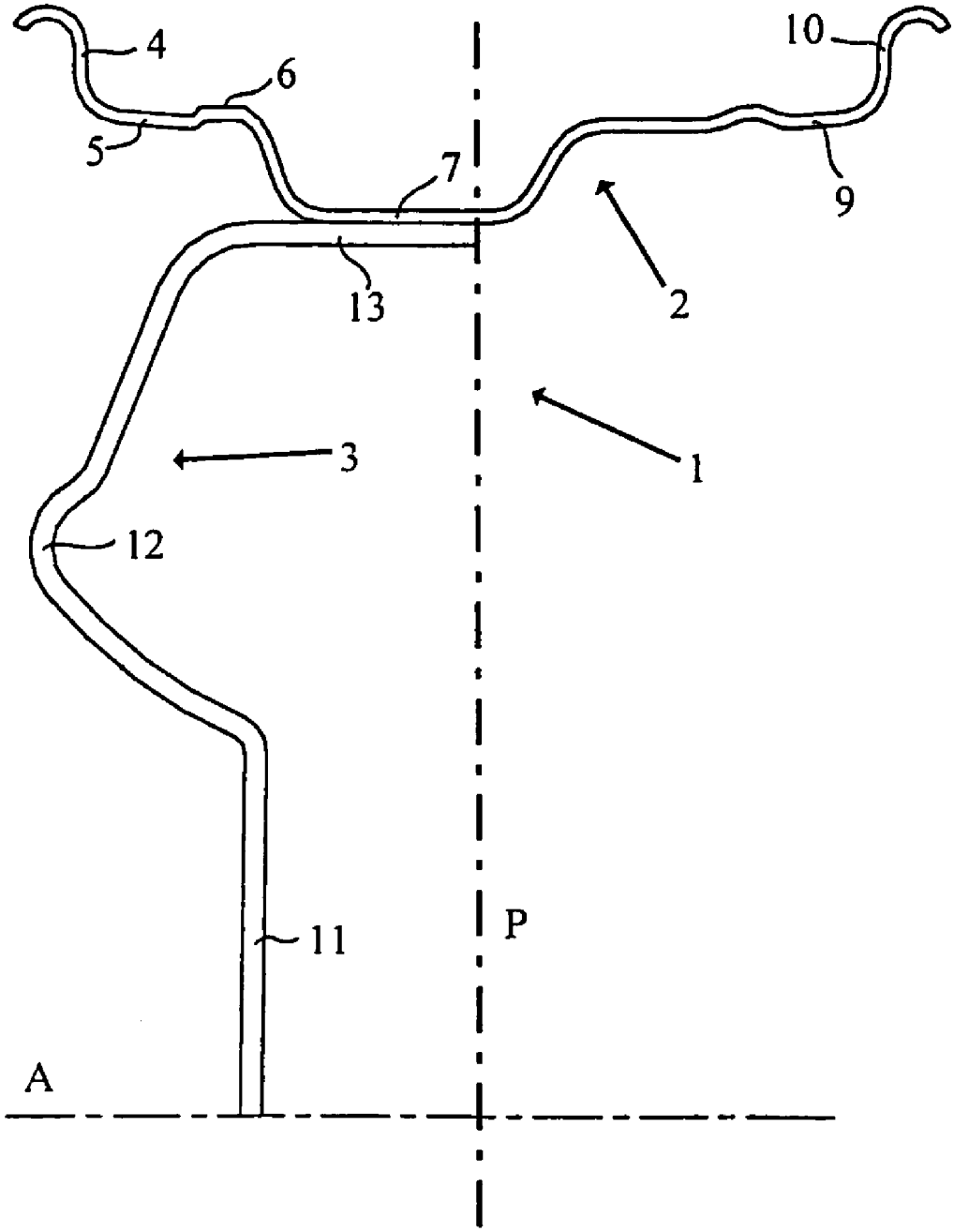
Fig. 1 (Prior Art)
FIG. 1 is a section of a conventional rim, with assembly below the mounting groove.

FIG. 1 shows a partial section of a conventional wheel of sheet steel. This wheel 1 comprises a rim 2 and a disc 3. This figure illustrates the median plane of the wheel, plane P. This plane is disposed equidistant from the two hooks of the rim. The axially inside and outside positions are defined with reference to the median plane P.

The rim has an outer hook 4, an outer seat 5, a hump 6, a mounting groove 7, an inner seat 9 and an inner hook 10. The disc 3 comprises a hub support face 11, a transition zone 12 and an assembly edge 13. Assembly is performed by fitting it below the mounting groove 7. Also visible in this figure is the axis of rotation A of the wheel.

Figure 2:
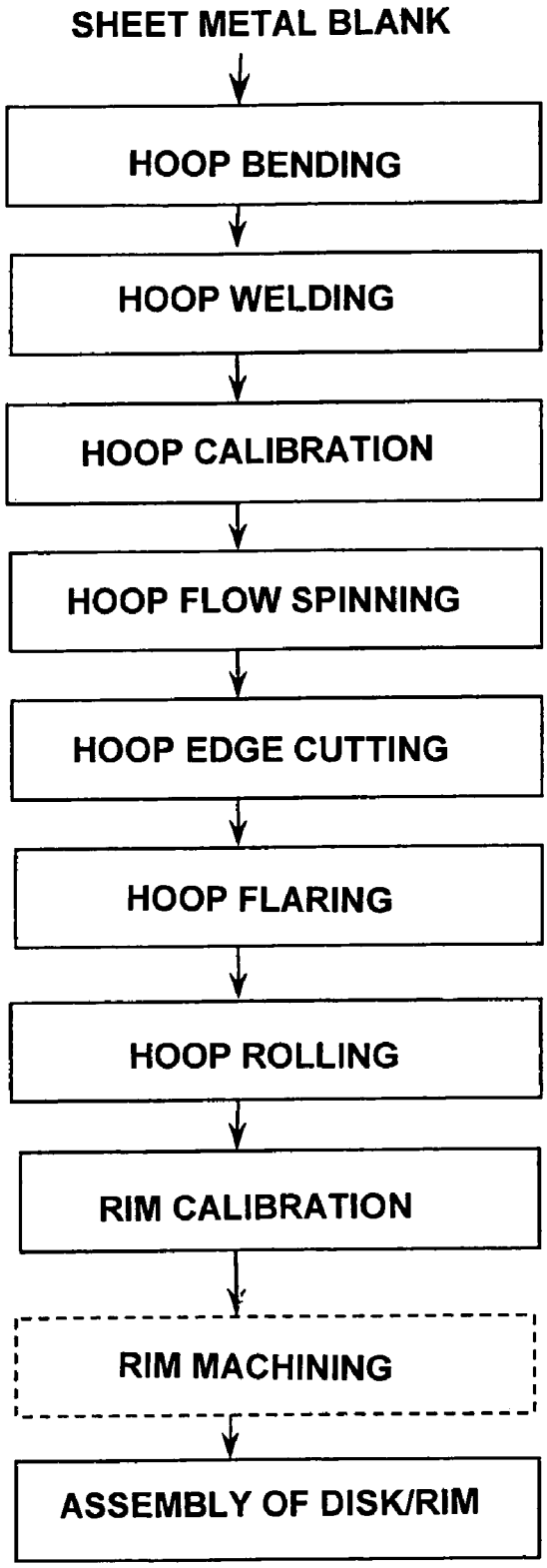
FIG. 2 shows the different steps of a method of making a wheel according to one embodiment of the invention.
Figure 3:
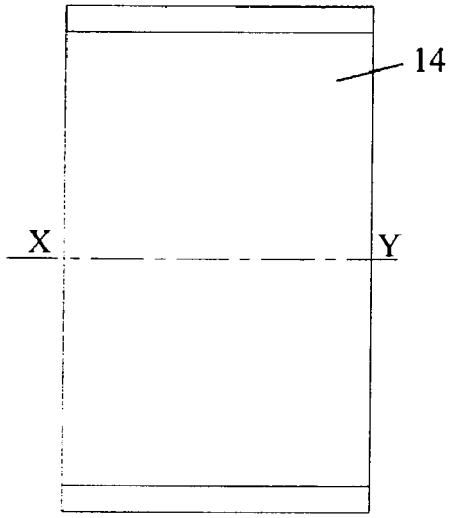
FIGS. 3, 4 and 5 illustrate diagrammatically different steps in the method of making a rim according to the invention.

A method of making wheel rims according to an embodiment of the invention is illustrated in FIG. 2. Initially, a sheet metal blank, made of, for example, steel, aluminum, or alloys, is bent to give it a generally cylindrical hoop shape 14 with two free edges. Then the hoop 14 is welded, such as by a flash welding, resistance welding, or other procedure. This hoop 14 has a constant thickness (FIG. 3).

Figure 4:
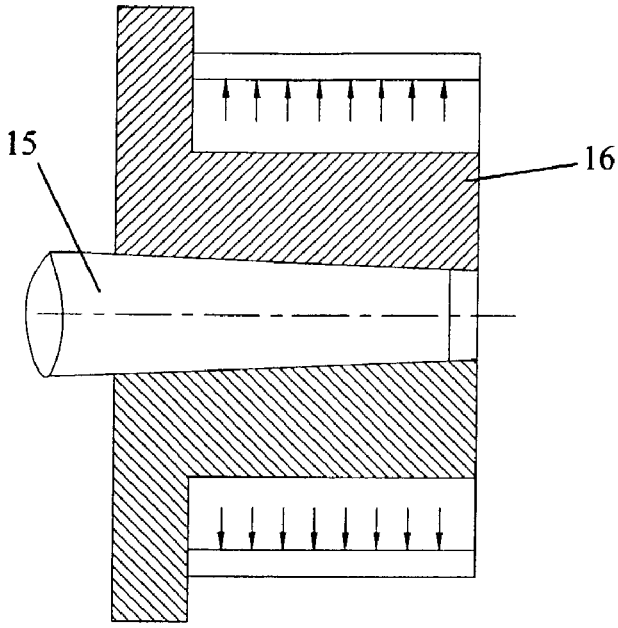

The hoop 14 is then preferably expanded to size. For example, the hoop may be expanded to size with the aid of a sizing tool shown diagrammatically in FIG. 4. The expansion is obtained by displacing a cam 15 that moves apart the sectors 16 around which the hoop 14 is installed.

Figure 5:
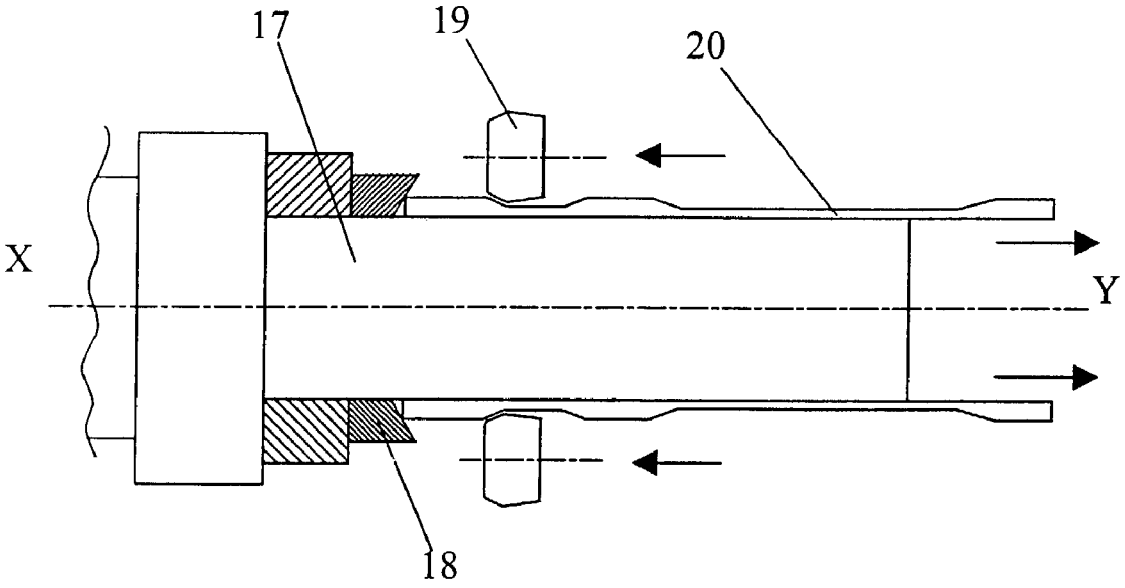

In FIG. 5, the flat profile desired for the rims is obtained by cylindrical flow spinning. In one embodiment, the flow spinning procedure used is reverse flow spinning. The hoop 14 is mounted on a mandrel 17 and comes to bear against a wall of the system 18 for immobilizing the hoop 14. The mandrel 17 is then rotated, and at least two rolls 19 roll over the radially outer surface of the hoop 14 in the zones where the thickness is to be reduced. Relative to the mandrel 17, the rolls 19 are displaced axially in the direction of the axis X, applying a radial and tangential force such that the flow of the material is in the direction Y. This flow of material is in the opposite direction to that of displacement of the rolls 19. FIG. 5 illustrates diagrammatically the hoop 20 obtained, with a variable profile.

This procedure of reverse flow spinning does not allow the thickness of the entire hoop to be reduced. In fact, each side of the hoop has to have a zone left which does not undergo flow spinning. On the side on which the rolls act, this would run the risk of destabilizing the hoop and damaging the rolls. On the side with the device for fixing the hoop and acting as a stop, a zone of axial width $L_{min}$ has to be left so that this device can clamp the edge of the hoop and rotate it during the flow spinning operation.

Figure 6:
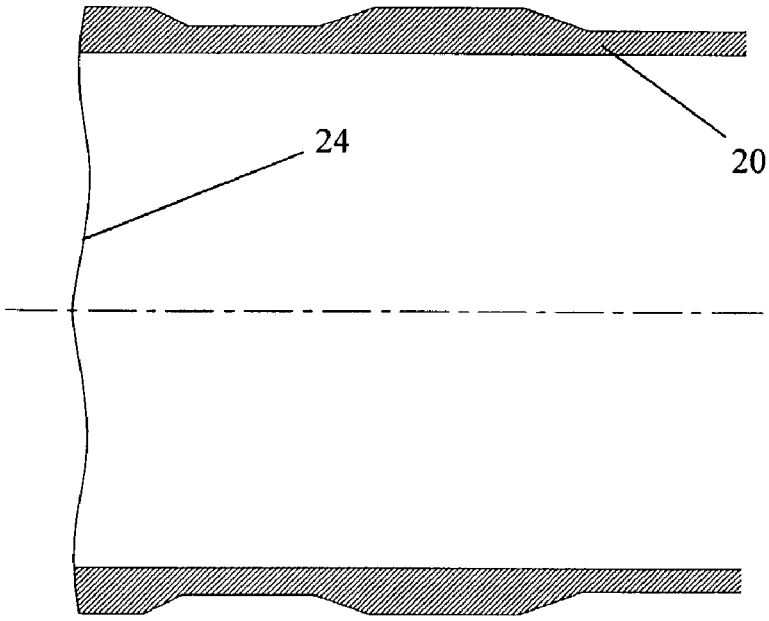
FIG. 6 shows diagrammatically a first type of fault encountered after the flow spinning operations.

FIG. 6 illustrates a first fault that the hoop 20 is susceptible of suffering after the flow spinning operations. This fault is in the form of local variations in the axial width of the hoop 20. These variations are observed in particular on the side on which the rolls act. The edge 24 is not perfectly cylindrical, having local variations in its axial position. These variations automatically have an effect on the profile of the rim. It is thus possible to have variations in the profile of the edge of the hooks, which may make it difficult to position or fix the balance weights in places.

Performing a cutting operation out of the two edges of the hoop after the flow spinning operations ensures a constant width in the hoop at all points on it.

Figure 7:
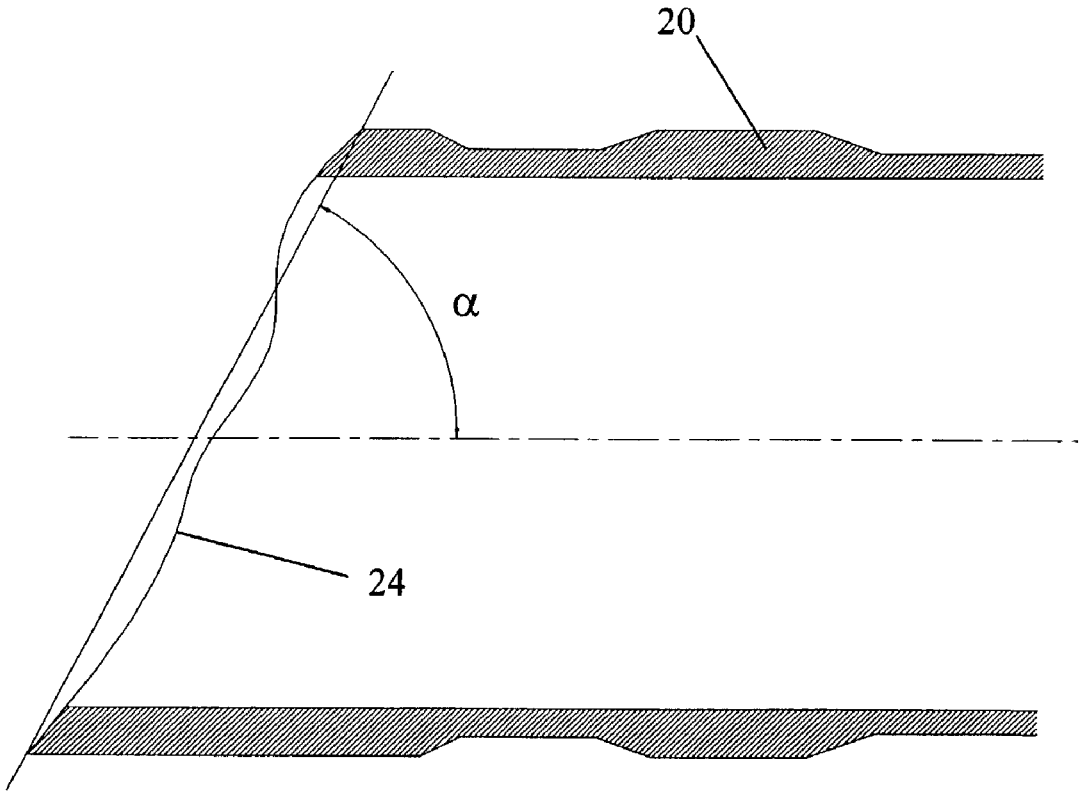
FIG. 7 shows diagrammatically a second type of fault encountered after the flow spinning operations.

FIG. 7 illustrates a second fault that may be observed, namely a fault in the perpendicularity between the plane defined by the edge 24 of the hoop 20 and that defined by the axis of the hoop 20. The angle $\alpha$ between these two planes may reach 1 to 2 degrees.

Performing a cutting operation out of an edge of the hoop after the flow spinning operations ensures the plane defined by this edge of the hoop is at a right angle to the axis of this hoop.

Figure 8:
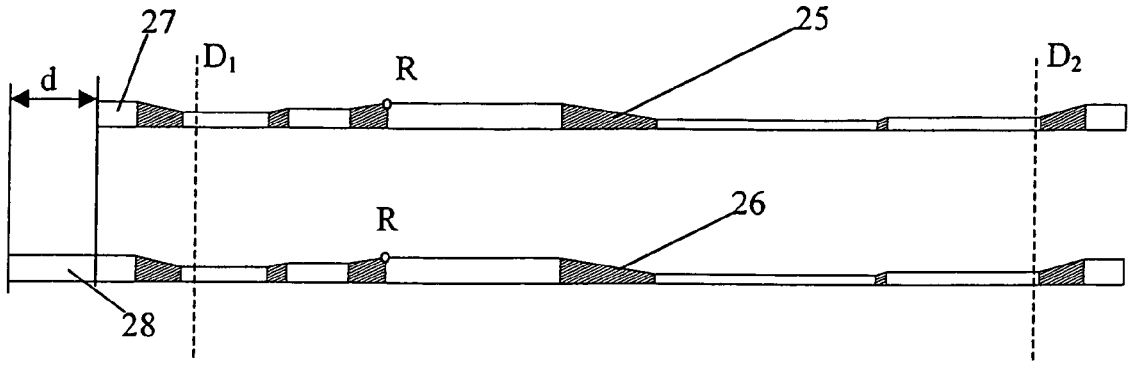
FIG. 8 shows diagrammatically a third type of fault encountered after the flow spinning operations.

FIG. 8 illustrates a third fault. In this figure, a part profile of two hoops 25 and 26 is visible. These two profiles are substantially identical, except for the length of the zones not subject to flow spinning, on the side abutting against the mandrel, which is shown in the left-hand side of the figure. These zones, 27 for the hoop 25, and 28 for the hoop 26, differ by a length d. This deviation is due to a variation between the two hoops in the thickness of the starting blank. The thickness of the starting blank of the hoop 26 is greater than that of the hoop 25. Despite this variation in the initial thickness, the profile of the two hoops is substantially identical after flow spinning, because the relative displacement of the rolls is linked to the axial thickening of the zones subject to flow spinning. On the other hand, for the same axial width of the hoops, the zone which is effectively subject to flow spinning is axially smaller for a thicker hoop. For a wheel rim for a passenger car having a diameter of 15 inches (381 mm), a variation in thickness of 0.05 mm may bring about a variation in the axial width of 5 mm in the zone not subject to flow spinning on the abutting side.

This problem is obviated by taking as a reference a characteristic point R on the profile of the hoop after the flow spinning operations, in order to define the position of the planes $D_1$ and $D_2$ for cutting out the edges of the hoop. This point R is advantageously taken adjacent to a zone of variable thickness and a zone of fixed thickness, as illustrated in FIG. 8. To increase precision, a system of checking the profile can be used to determine the position of the cutting-out plane or two cutting-out planes, as appropriate. It should be noted that the edge of the hoop on the side on which the rolls act should not be used as a reference point R since this is the edge most sensitive to the variations and undulations, as mentioned above.

Figure 9B:
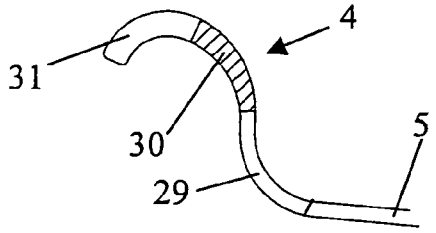
FIGS. 9(*a*) and 9(*b*) show diagrammatically a detail of a first hoop corresponding to the rim hook after the flow spinning operations, and the part of the rim resulting therefrom after profiling.
Figure 9A:
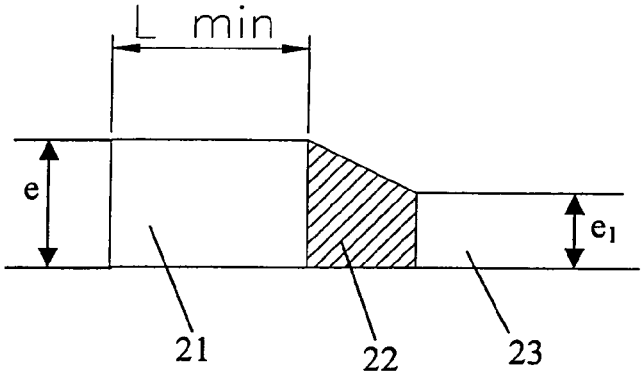

FIG. 9(*a*) illustrates diagrammatically the profile of one of the ends of the hoop 20 after the flow spinning operation. This profile comprises an outer zone 21 not subject to flow spinning, of axial width $L_{min}$ and thickness e corresponding to the thickness of the starting blank, a transition zone 22 in which the thickness lessens progressively and a zone 23 of reduced thickness $e_1$.

FIG. 9(*b*) shows the profile of the outer edge of the rim obtained after the operations of roll profiling. The first zone 21 of FIG. 9(*a*) corresponds to the edge 31 of the rim hook 4. The zone of reduced thickness 23 of FIG. 9(*a*) corresponds to the seat 5 of the rim and to the start 29 of the hook. The transition zone 22 of FIG. 9(*a*) corresponds to the intermediate zone 30.

The hook 4 of the rim thus has three adjacent zones: the zone 29 of reduced thickness identical to that of the seat 5, the transition zone 30, whereof the thickness increases progressively, and the zone 31 of thickness e identical to that of the starting blank.

The hook 4 in FIG. 9(*b*) thus shows an excess thickness which may or may not be necessary, depending on the type of wheel concerned.

Figure 10B:
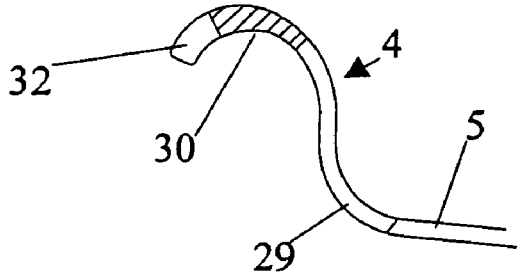
FIGS. 10(*a*) and 10(*b*) illustrate diagrammatically a detail of a second hoop corresponding to the rim hook after the flow spinning operations, and the part of the rim resulting therefrom after profiling.
Figure 10A:
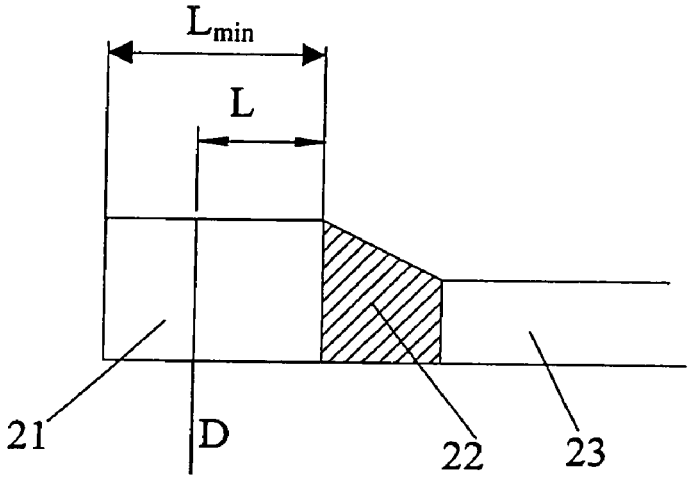
Figure 11B:
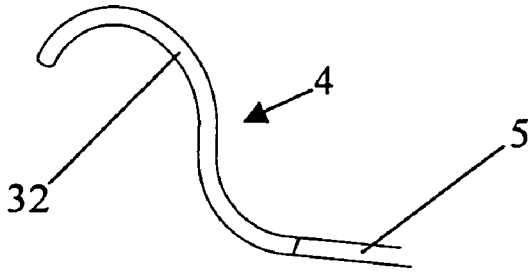
FIGS. 11(*a*) and 11(*b*) illustrate diagrammatically a detail of a third hoop corresponding to the rim hook after the flow spinning operations, and the part of the rim resulting therefrom after profiling.
Figure 11A:
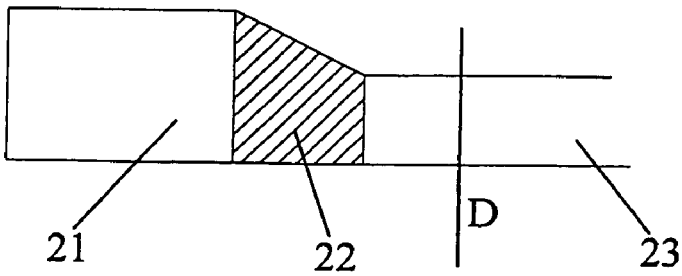

FIGS. 10(*a*) and 10(*b*) and FIGS. 11(*a*) and 11(*b*) show two shapes of hooks obtained from two different cutting-out operations. In the case of FIG. 10, the plane of cutting out D is located axially at a spacing L from the point where the zone 21 not subject to flow spinning, of thickness e, and the transition zone 22, of a thickness variable between e and $e_1$, meet. The result is that, after the cutting-out operation, the hook 4 has a zone 32 of reduced thickness e. The rim is therefore lighter in weight.

In FIG. 11, the plane of cutting out is located in the zone 23, which has been subject to flow spinning in order to reduce its thickness from e to $e_1$. The hook obtained after the profiling operations therefore has an identical thickness over its entire length. This therefore gives the maximum reduction in weight.

It should be noted that in order to make the embodiments shown in FIGS. 9 to 11 clearer, their scale in the direction perpendicular to the axis of the hoop has been made approximately five times that of the scale in the direction of the axis of the hoop.

Various methods of cutting out of the edge of the hoop, such as by turning or roll cutting, are known to those skilled in the art. After the operations of roll profiling the hoop, the rims thus obtained are set to the correct size, then fitted onto appropriate discs.

FIG. 2 includes a step of machining the zone for fitting on the rim which is also well known to one skilled in the art. This step is optional. The objective of this step is to optimize the cylindrical geometric shape of the fitting zone in the case of sensitive assembly.

The present invention can be variously modified without departing from the spirit and scope of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The disclosures of each reference cited above is herein incorporated by reference.

What is claimed is:

1. A method of making a rim of sheet metal for a vehicle wheel, comprising:

A) obtaining a rectangular geometric shape from a blank of sheet metal;

B) bending the blank to obtain a hoop having a cylindrical inner surface and a cylindrical outer surface;

C) welding the two free edges of the hoop together;

D) setting the size of the hoop subsequent to step C;

E) performing at least one cylindrical flow spinning operation on the cylindrical sized hoop to obtain a profile of given thickness of the hoop, wherein said hoop has zones of constant thickness adjacent to zones of variable thickness, wherein the inner surface remains cylindrical and the outer surface is profiled thereafter;

F) making a cut perpendicular to the axis of the cylindrical inner surface of the hoop out of at least one lateral edge of the hoop; thereafter G) flaring both lateral edges of the hoop to form respective rim hooks; and H) profiling the hoop to obtain the rim.

2. The method according to claim 1, wherein said rim has an inner side and an outer side and wherein the lateral edge of the hoop corresponding to the inner side of the rim is cut out.

3. The method according to claim 1, wherein the two lateral edges of the hoop are cut out.

4. The method according to claim 1, wherein a part of the zone not subject to flow spinning is cut out at the edge of the hoop.

5. The method according to claim 1, wherein at least part of the zone subject to flow spinning is cut out at the edge of the hoop.

6. The method according to claim 1, wherein the plane of cutting out of an edge of the hoop is defined with reference to a characteristic point on the profile of the hoop after the flow spinning operation.

7. The method according to claim 6, wherein said characteristic point corresponds to a point of transition between a zone of constant thickness and a zone of variable thickness.

8. The method according to claim 1, further comprising subsequent to step H, the steps of setting the size of said rim and then machining the zone of fitting the rim.

* * * * *